United States Patent [19]

Santucci

[11] 4,430,524

[45] Feb. 7, 1984

[54] BRIDGING CLIP COVER

[76] Inventor: Donald Santucci, 1708 Shire Ct., Wheaton, Ill. 60187

[21] Appl. No.: 360,198

[22] Filed: Mar. 22, 1982

[51] Int. Cl.[3] ..... H01R 13/44

[52] U.S. Cl. ..... 174/138 F; 339/19; 339/36; 339/198 J

[58] Field of Search ..... 174/138 F; 339/19, 36, 339/116 R, 116 C, 198 J, 213 R, 213 T, 222, 256 R

[56] References Cited

U.S. PATENT DOCUMENTS 2,643,362 6/1953 Johansson ..... 339/36

3,641,476 2/1972 Drake ..... 339/36

3,735,332 5/1973 Tirrell ..... 174/138 F X

*Primary Examiner*—Laramie E. Askin

*Attorney, Agent, or Firm*—McDougall, Hersh & Scott

[57] ABSTRACT

A plastic cover for bridging clips of the type commonly utilized on telephone and communications terminal blocks. The cover is dimensioned to closely conform to the contour of the associated clip and includes partial end walls and nibs which function to enhance retention of the clip. The cover may be field installed on an existing bridging clip without the removal of same, or pre-assembled with a clip prior to installation.

5 Claims, 5 Drawing Figures

FIG. 1
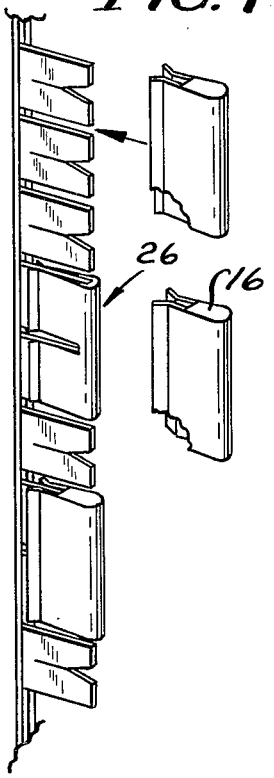
FIG. 2
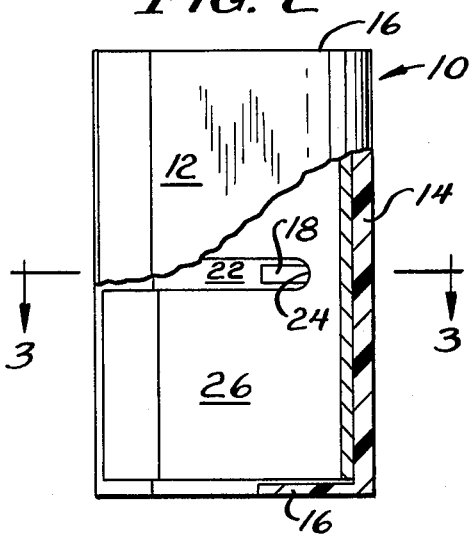
FIG. 3
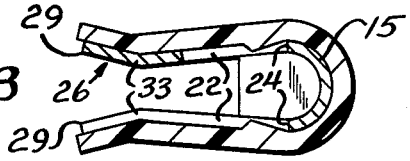
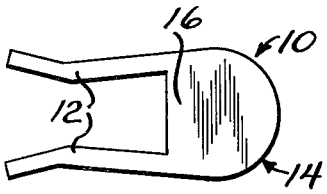
FIG. 4
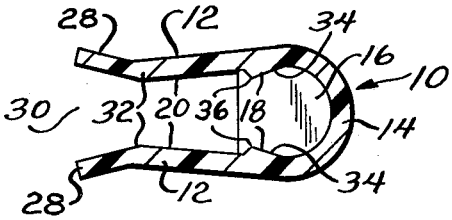
FIG. 5

BRIDGING CLIP COVER

This invention relates to a device for electrically insulating and/or tagging electrical bridging clips of the type commonly employed in telephone and communications interconnecting terminal blocks and, in particular, to a plastic cover which can be slipped over and retained by an associated bridging clip either in the field following installation of the clip or prior to delivery and installation as a pre-assembled insulated bridging clip.

Conventional bridging clips are generally open ended U-shaped members fabricated of resilient or springy electrically conductive material such as phosphor bronze which are positioned over two or more adjacent terminal block contacts to form an electrical connection therebetween. A typical terminal block includes a dozen or more parallel rows of contacts, each row, similarly, containing as many as a dozen or more individual contacts. Bridging clips are positioned throughout the terminal block as required to interconnect the various circuits. This often results in clips being located immediately adjacent one another either in the same or adjacent rows.

Installation of individual bridging clips is accomplished by urging the open end of the U-shaped clip onto the respective contact terminals. Similarly, removal of a bridging clip can be effected by grabbing or pulling the clip outwardly with a pair of pliers or other appropriate tool.

Use of such terminal interconnect blocks in the telephone and communications fields necessarily requires, from time to time, the removal or installation of additional bridging clips to reflect changing customer requirements. These changes must be accomplished without interruption of other existing customer circuits interconnected within the same terminal block.

Unfortunately, installation and removal of conventional noninsulated bridging clips often produces undesirable circuit interruptions or inadvertent linking of circuits by reason of the shorting of adjacent terminals. For example, it is not uncommon, when urging a bridging clip onto a pair of contacts, for the clip to slip longitudinally thereby inadvertently contacting the next adjacent contact within the same row. Shorting to adjacent contacts may also occur where a lineman attempts to remove the clip by prying one end of the clip upwardly. In such instance, the clip tends to slide and rotate until the uninsulated metallic portion contacts the adjacent terminal possibly disturbing an existing communications circuit. Additionally, problems have been observed where metallic tools such as pliers are utilized to grab the clips either during installation or removal. There is a great tendency for the pliers to contact an adjacent row of terminals, particularly where the space between adjacent rows is further reduced by the presence of a bridging clip on these adjacent terminals. Again, this greatly increases the likelihood of disruption or interference to existing circuits.

Misidentification of circuits and the resulting interruption of communications connections upon the inadvertent removal of misidentified bridging clips, even momentarily, can create serious false signaling in certain applications such as security and computer systems. Conventional metallic bridging clips incorporate no means for readily identifying and distinguishing important circuits that must remain intact.

These problems have been recognized and various solutions have been proposed and some implemented. One approach, which has not proven satisfactory, involves dipping the metallic clip into, or spraying the clip with, an insulative material such as rubber. While this process produces an insulative cover on the outside of the clip, it has proved impractical to fully mask the interior contacting surfaces of the clip so as to avoid accumulations of insulative material in these regions. The insulative coating on these interior surfaces functions to create an electrical barrier between the clip and terminal to which an electrical contact was intended. Further, this technique cannot be applied as a retrofit to existing clips already installed and, further, affords little protection against longitudinal movement of the clip into adjacent contacts as discussed above. Finally, the insulative coating has been found to be susceptible to damage or puncture during installation and removal thereby destroying its insulative quality.

An alternative approach, known to and investigated by this inventor, is a U-shaped extruded or molded plastic cover which can be inserted onto previously installed clips. The absence of end walls on these covers, again, affords little protection against the longitudinal movement of the clip into adjacent contacts and, in addition, it has been found that the cover itself often slides longitudinally with respect to the clip. Further, these covers exhibit poor clip retention properties and often become detached from the clip, for example, during attempted clip removal.

Yet another approach is a plastic cover having a ledge of ridge running along and protruding inwardly from the parallel bottom edges of the clip sides. These ledges function to preclude removal of the clip once installed. However, initial clip insertion and cover "tooling" considerations mandate the use of a two-piece cover construction which must, necessarily, be assembled around the bridging clip. This follows from the fact that the ledges, which serve to positively retain the clip within the cover in the first instance, similarly preclude the insertion of the clip into the cover and, further, preclude the removal of the core member generally required to injection mold single-piece covers. Therefore, use of a two-piece cover is unsatisfactory for the reason that it requires an expensive post-molding joining operation which necessarily must be performed during manufacture with the clip in the proper position. Thus, such a cover is not suited to field installation.

The plastic injection molded clip cover of this invention meets the desired bridging clip insulation and marking objectives while being easily and inexpensively injection molded as a single integral piece. Unlike conventional plastic predecessors, the inclusion of internal nibs, partial end-walls, and sidewalls closely contoured to the clip assures a clip cover which will positively engage and retain the clip therein even under the forces arising from removal of the clip from an associated pair of terminals. Further, the partial end-walls of this clip effectively block longitudinal travel of the clip and, in the event that the clip is forced longitudinally, renders electrical 'shorting' contact with adjacent terminals in the same row substantially impossible. The clip cover of this invention, further, permits insertion of the clip either at the factory or in the field on clips already installed on terminal block contacts.

An object of this invention, therefore, is a cover for a bridging clip which can be simply and inexpensively manufactured as an integral one-piece unit, for example, by plastic injection molding. This cover may be installed on bridging clips already in use in the field or may be supplied with the bridging clip therein for subsequent installation on terminal blocks. The bridging clip cover of this invention, further, maintains firm engagement with the bridging clip therein to preclude the inadvertent exposure of the bridging clip particularly during removal of the clip from a terminal assembly. This cover, additionally, precludes the longitudinal movement of the bridging clip and, in the event such clip should be dislodged, prevents the inadvertent contact or "shorting" to adjacent contact terminals. Finally, the bridging clip cover of this invention may be molded in various colors thereby providing a means for rapidly identifying critical circuits to minimize the likelihood of inadvertent circuit tampering.

Other objects and advantages of the invention will be apparent from the following specification and the accompanying drawings in which:

FIG. 1 is a perspective view of contact terminals forming a single row of an overall terminal block illustrating a bridging clip with the cover of this invention thereon positioned above a pair of contact terminals prior to insertion thereon; a conventional non-insulated bridging clip properly positioned on a pair of terminals with a clip cover of this invention positioned above the clip ready for installation; and a bridging clip with a cover thereon installed on yet another pair of terminals;

FIG. 2 is a side view of the bridging clip cover of this invention with portions broken away to reveal the bridging clip therein;

FIG. 3 is a sectional view taken substantially along line 3—3 of FIG. 2 illustrating the contoured shape and nibs of the clip cover of this invention shown in relation to a bridging clip positioned therein;

FIG. 4 is an end view of the overall bridging clip cover without a clip therein showing the partial end walls of this cover; and FIG. 5 is a cross-sectional view taken substantially along lines 3—3 of FIG. 2 showing the bridging clip cover of this invention without a clip therein.

DESCRIPTION OF THE PREFERRED EMBODIMENT

The bridging clip cover of this invention is shown generally in the figures at 10 and defines a generally U-shaped member having a pair of side walls 12 interconnected by a semi-cylindrical top region or bridge 14 and a pair of partial end-walls 16. A pair of nibs 18 are provided on opposing inside surfaces 20 of side walls 12 substantially midway between end-walls 16. These nibs are spaced from the bridge 14 of the cover a distance to allow the nibs to protrude into respective bridging clip apertures 22 which define corresponding aperture limits 24 upon proper insertion of a clip 26 into the bridging clip cover 10.

Nibs 18 have a generally triangular cross-section in a plane perpendicular to the longitudinal axis of the cover and have a relatively gradual sloping relief 34 extending from the nib tip 36 in the direction of the cover bridge 14. This nib contour was selected as providing acceptable clip retention while facilitating relatively unobstructed removal of the core member used to injection mold these clip covers. This invention, however, contemplates the use of other nib contours consistent with proper cover retention and molding core removal.

Walls 12 are generally parallel along the longitudinal cover axis but converge away from bridge 14 to knees 32 beyond which the walls diverge to form flared ends 28. The region between ends 28 defines a clip receiving opening 30.

The overall clip cover is contoured and dimensioned to closely embrace the clip positioned therein thereby enhancing the retention of such clip. To this end, each region of the clip cover is contoured and dimensioned to conform and engage corresponding regions of the clip. Thus, the inside diameter of bridge 14 is approximately the same, but slightly greater than, the corresponding outside diameter of the clip top region 15. Similarly, the longitudinal dimension between inside surfaces of walls 16 is slightly longer than the overall clip length to non-interferingly receive the clip therebetween. Further, the spacing of knees 32 from bridge 14 is selected so that these knees 32 engage corresponding clip indentations 33. However, flared ends 28 extend somewhat beyond corresponding clip end 29 as shown in FIG. 3 to minimize the possibility of inadvertent 'shorting' contact to the bottom of the clip.

The spacing or convergence of walls 12 may be advantageously selected so that the wall spacing adjacent knees 32 is somewhat lesser than the corresponding spacing between outer surfaces of clip walls. In this manner, insertion of clip 26 into cover 10 pivots wall 12 slightly outwardly thereby creating a compressive biasing force between walls 12 which functions to enchance retention of clip 26 and to assure proper engagement of nibs 18 within openings 22. Alternatively, the spacing and covergence of walls 12 may be substantially the same as the corresponding outer surfaces of clip 26. In such a case, little or no biasing force is exerted upon the clip by the cover once the clip is properly positioned therein. It can be appreciated that the convergence of walls 12 acts to block removal of the clip whether walls 12 are biased against a properly positioned clip or not. This follows by reason that the width of the upper region of the clip is greater than the spacing between facing clip knees 32. Thus, any movement of the clip outwardly through opening 30 necessarily causes walls 12 to rotate outwardly apart. The intrinsic rigidity of the plastic clip cover material resists such a rotational or bending motion thereby generating a gripping force between walls 12 which acts to clamp and restrain clip 26 against further outward movement.

An important feature of the clip cover of this invention is its ability to maintain engagement of the clip therein under all normal conditions including those encountered during removal of a clip from an associated pair of terminals. In addition to the close fitting contour of this cover, clip retention is augmented by partial end walls 16. End walls 16 perform two important although quite dissimilar functions. First, end walls 16 shield and insulate adjacent clip ends against inadvertent shorting contact with adjacent terminal contacts, clips or tools during installation and removal of the clip and, further, to block longitudinal movement of the clip cover with respect to the clip. Conventional plastic clip covers without end walls are known to slide laterally thereby exposing portions of the metallic clip and, in some instances, to completely disengage the clip.

The second function of end walls 16 relates to enhancing the clip retention capabilities of this cover. As best seen in FIGS. 3 and 4, integral end walls 16 bridge side walls 12 from the bridge 14 to a point approximately one-third the distance to the tip of flared ends 28 at opening 30. Generally, this includes the sidewall portions containing nibs 18. End walls 16 effectively brace bridge 14 and the adjacent portions of side walls 12 against rotational or parting movement thereby enhancing the positive engagement of nibs 18 with respective clip at apertures 22. Further, this partial bridging of side walls 12 increases the overall rigidity and strength of walls 12 thereby further resisting the outward rotation of walls 12 necessary to remove the clip while maintaining a degree of wall flexibility necessary for initial clip insertion.

Retention of the clips is further enchanced by the engagement of nibs 18 with the clip at apertures 22. Conventional bridging clips incorporate centered apertures 22 through each wall. One typical clip, for example, includes a slot in one wall dividing the wall surface into two contact regions and a rectangular aperture in the other wall. Each aperture, although of differing shape, has an upper opening limit 24 spaced a similar distance from clip top region 15. Nibs 18 are positioned to protrude into apertures 22 and to engage limits 24 upon attempted withdrawal of the clip from the cover.

The clip cover of this invention has been advantageously designed to be inexpensively injection molded from plastic or other suitable material. Further, this cover is integrally fabricated as a complete one-piece unit without the expensive and limiting subsequent steps of sonically welding or otherwise adhering clip cover halves together as required by other known clip cover techniques. Specifically, nibs 18 are designed to permit an otherwise conventional mold core (not shown) to slide outwardly from cover 10 after molding without damge to the nibs. Further, the resilience of walls 12, necessary to ultimately admit passage of clip 26, similarly permits flexure as the core is removed.

Covers may be molded in suitable colors to provide a means for tagging and identifying particular circuits. In this manner, highly important circuits, such as alarm or computer circuits, can be distinctly marked and readily identified thereby lessening possibilities for inadvertent tampering and circuit interruption.

The clip covers of this invention are adapted for either factory of field insertion of the clips. Thus, these covers may be supplied ready for immediate use in new installations with clips therein or the covers may be supplied separately to be positioned over existing non-covered bridging clips. Insertion of the clips into the cover requires no tools and may be accomplished simply by pushing the two pieces into engagement until the clip snaps into position. Similarly, use of these covers on existing bridging clip terminal connections does not require interruption of the circuit; rather, the cover is easily pushed onto the respective clip. It can be appreciated that the integral cover of this invention offers significant advantages over the alternative two-piece cover which necessarily requires insertion of the clip prior to joining during manufacture. Therefore, this cover may be used to tag and insulate important existing circuits without causing an interruption of these circuits as covered clips are substituted for non-covered clips.

I claim:

1. An integral one-piece cover for an electrically conductive bridging clip comprising:

(a) a body having an electrically insulative portion comprised of substantially electrically non-conductive semi-rigid plastic material for enclosing the exposed surfaces of a bridging clip when installed on a terminal block and for preventing unintended electrical contact between adjacent bridging clips on a terminal block; the body having surfaces facilitating manual application of the integral one-piece cover to a bridging clip prior to or after installation thereof on a terminal block; the body including a pair of spaced apart generally facing rectangular sidewalls, each sidewall having an upper edge, a lower edge and two end edges; a bridge disposed between and extending along respective sidewall upper edges, wherein said bridge and sidewalls define a surface having a generally U-shaped cross-section; a pair of opposed partial end walls between adjacent sidewall end edges extending from the bridge downwardly to a point above the sidewall lower edges;

(b) retention means on the body for maintaining firm but selectively releaseable engagement of the one-piece cover with a bridging clip, the retention means including said body sidewalls shaped to closely conform to a bridging clip, the lower sidewall edges being spaced apart a distance less than the upper sidewall edges and less than the width of a bridging clip whereby interfering engagement of closely spaced lower portions of the sidewalls with a bridging clip when positioned within the one-piece cover will function to inhibit outward movement of the bridging clip from the one-piece cover, said pair of opposed partial end walls functioning to maintain the sidewalls, including their lower edges, at said spaced distance.

2. The integral one-piece cover of claim 1 wherein the retention means includes at least one nib integral with the sidewall facing surfaces for engaging a bridging clip.

3. The integral one-piece cover of claim 1 wherein the retention means includes generally opposed nibs integral with facing surfaces of said sidewalls, the nibs being disposed substantially midway between said opposed partial end walls, each nib being spaced from the bridge to engage respective bridging clip apertures.

4. The integral one-piece cover of claim 3 wherein each of the nibs includes a bridging clip engaging surface extending from a first nib point on the sidewall surface closest the bridge to a second point of maximum normal extension of the nib from said sidewall surface, said engaging surface having a gradually sloping contour whereby a molding die core can be retracted during fabrication.

5. The integral one-piece cover of claim 1 wherein the retention means includes (a) generally opposed nibs integral with facing surfaces of said sidewalls, the nibs being disposed substantially midway between said opposed partial end walls, each nib being spaced from the bridge to engage respective bridging clip apertures; and (b) said opposed partial endwalls functioning to maintain said nibs in engagement with respective bridging clip apertures.

* * * * *